US011930935B1

(12) United States Patent
Kromer, Jr.

(10) Patent No.: US 11,930,935 B1
(45) Date of Patent: Mar. 19, 2024

(54) CONVERTIBLE SWINGING SEAT

(71) Applicant: Gary C Kromer, Jr., Knoxville, TN (US)

(72) Inventor: Gary C Kromer, Jr., Knoxville, TN (US)

( * ) Notice: Subject to any disclaimer, the term of this patent is extended or adjusted under 35 U.S.C. 154(b) by 0 days.

(21) Appl. No.: 18/446,700

(22) Filed: Aug. 9, 2023

(51) Int. Cl.

| | |
|---|---|
| ***A47C 3/025*** | (2006.01) |
| ***A45F 3/26*** | (2006.01) |
| ***A47C 1/02*** | (2006.01) |
| ***A47C 17/175*** | (2006.01) |
| ***A63G 9/00*** | (2006.01) |

(52) U.S. Cl.
CPC ..... *A47C 3/0255* (2013.01); *A45F 3/26* (2013.01); *A47C 1/02* (2013.01); *A47C 17/1756* (2013.01); *A63G 9/00* (2013.01)

(58) Field of Classification Search
CPC ..... A47C 3/0255; A47C 1/02; A47C 17/1756; A45F 3/26; A63G 9/00
USPC ..... 297/278–281; 5/125
See application file for complete search history.

(56) References Cited

U.S. PATENT DOCUMENTS 371,065 A * 10/1887 Hendrickson ..... A45F 3/26 297/423.26
595,335 A * 12/1897 Palmer ..... A45F 3/26 297/278
636,669 A * 11/1899 Jesseman ..... A45F 3/22 297/279
787,556 A * 4/1905 Bottgar ..... A45F 3/26 297/278
787,760 A * 4/1905 Higgins ..... A61G 7/1055
831,167 A * 9/1906 Kurfees et al. ..... F21V 21/38 248/320
998,689 A * 7/1911 Irvine ..... A45F 3/22 5/124
1,013,956 A * 1/1912 Sanders ..... A47C 13/00 297/7
1,198,912 A * 9/1916 Haberbacker ..... A47C 1/035
1,266,129 A * 5/1918 Killman ..... A47C 1/06 297/281
1,529,185 A 3/1925 Jones
3,615,119 A * 10/1971 Irwin ..... A63G 9/00 297/281

(Continued)

FOREIGN PATENT DOCUMENTS

AT 136657 B 2/1934
DE 1083997 B 6/1960

(Continued)

*Primary Examiner* — Robert Canfield
(74) *Attorney, Agent, or Firm* — Robinson IP Law, PLLC

(57) ABSTRACT

Various implementations include a convertible swinging seat assembly. The assembly includes a seat and at least four suspenders. The seat includes four segments. A first end of a second segment is pivotably coupled to a second end of the first segment at a first joint. A first end of a third segment is pivotably coupled to a second end of the second segment at a second joint. A first end of a fourth segment is pivotably coupled to a second end of the third segment at a third joint. The first, second, and third joints are independently pivotable relative to each other. The suspenders each have a first suspender portion and a second suspender portion. The second suspender portion of each suspender is coupled to a different one of the first, second, third, and fourth segments.

17 Claims, 7 Drawing Sheets

(56) References Cited

U.S. PATENT DOCUMENTS

| | | | | | |
|---|---|---|---|---|---|
| 4,828,250 | A * | 5/1989 | Reiche | A47C 3/0255 | 297/279 |
| 5,058,951 | A * | 10/1991 | Thiel | A47C 3/0255 | 248/370 |
| 5,788,327 | A * | 8/1998 | Gregory | A47C 3/0255 | 297/423.3 |
| 6,019,427 | A * | 2/2000 | Combest | B60P 3/36 | 297/277 |
| 6,343,838 | B1 * | 2/2002 | Bagshaw | A63G 9/00 | 297/278 |
| 11,800,923 | B1 * | 10/2023 | Shirley-Smith | A63G 9/00 | |

FOREIGN PATENT DOCUMENTS

| | | | |
|---|---|---|---|
| DE | 1827142 | U | 2/1961 |
| DE | 3639474 | A1 | 11/1989 |
| GB | 203582 | A | 9/1923 |

* cited by examiner

CONVERTIBLE SWINGING SEAT

BACKGROUND

Swinging or hanging benches, chairs, or seats provide a rocking motion when in use, which is found by some to be relaxing. However, many swinging benches are made to be in a single position (i.e., the upright position) and do not allow for adjustment based on a user's comfort.

Previous attempts at providing configurable swinging seating allow for reclining seats but fail to allow for further configurations.

Thus, there is a need for a swinging seating device that allows for multiple configurations to suit a user's needs.

SUMMARY

Various implementations include a convertible swinging seat assembly. The assembly includes a seat and at least four suspenders. The seat includes a first segment, a second segment, a third segment, and a fourth segment. The first segment has a first end and a second end opposite and spaced apart from the first end of the first segment. The second segment has a first end and a second end opposite and spaced apart from the first end of the second segment. The first end of the second segment is pivotably coupled to the second end of the first segment at a first joint. The third segment has a first end and a second end opposite and spaced apart from the first end of the third segment. The first end of the third segment is pivotably coupled to the second end of the second segment at a second joint. The fourth segment has a first end and a second end opposite and spaced apart from the first end of the fourth segment. The first end of the fourth segment is pivotably coupled to the second end of the third segment at a third joint. The first joint, the second joint, and the third joint are independently pivotable relative to each other. The at least four suspenders each have a first suspender portion and a second suspender portion opposite and spaced apart from the first suspender portion. The second suspender portion of a first suspender is coupled to the first segment, the second suspender portion of a second suspender is coupled to the second segment, the second suspender portion of a third suspender is coupled to the third segment, and the second suspender portion of a fourth suspender is coupled to the fourth segment.

In some implementations, the assembly further includes a frame having a first portion and a second portion opposite and space apart from the first portion. In some implementations, the first portion is configured to be disposed higher than the second portion relative to a gravitational axis in use. In some implementations, the first suspender portion of one or more of the at least four suspenders is coupled to the first portion of the frame.

In some implementations, the suspender includes a chain. In some implementations, the suspender includes a rope.

In some implementations, each suspender includes a pair of suspenders. Each of the suspenders in the pair of suspenders is coupled to an opposite side of a respective segment.

In some implementations, the second suspender portion of the second suspender is coupled to a portion of the second segment spaced apart from the first joint and the second joint. In some implementations, the second suspender portion of the third suspender is coupled to a portion of the third segment spaced apart from the second joint and the third joint. In some implementations, the portion of the second segment to which the second suspender portion of the second suspender is coupled is closer to the second joint than it is to the first joint. In some implementations, the portion of the third segment to which the second suspender portion of the third suspender is coupled is closer to the second joint than it is to the third joint.

In some implementations, a distance between the first suspender portion and the second suspender portion of each of the at least four suspenders is adjustable. In some implementations, the second suspender portion includes a quick link. In some implementations, the second suspender portion includes a carabiner. In some implementations, the second suspender portion includes a hook.

In some implementations, the second joint includes a second primary hard stop. In some implementations, the second primary hard stop prevents over-rotation of the second joint in a first rotational direction beyond a plane defined by the second segment and a plane defined by the third segment being parallel to each other. In some implementations, the second joint includes a second secondary hard stop. In some implementations, the second secondary hard stop prevents over-rotation of the second joint in a second rotational direction beyond a predetermined angle formed by the plane defined by the second segment and the plane defined by the third segment.

In some implementations, the first joint includes a first primary hard stop and the third joint includes a third primary hard stop. In some implementations, the first primary hard stop prevents over-rotation of the first joint in a second rotational direction beyond a plane defined by the first segment and the plane defined by the second segment being parallel to each other. In some implementations, the third primary hard stop prevents over-rotation of the third joint in the second rotational direction beyond the plane defined by the third segment and a plane defined by the fourth segment being parallel to each other.

In some implementations, the first joint includes a first secondary hard stop and the third joint includes a third secondary hard stop. In some implementations, the first secondary hard stop prevents over-rotation of the first joint in the first rotational direction beyond a predetermined angle formed by the plane defined by the first segment and the plane defined by the second segment. In some implementations, the third secondary hard stop prevents over-rotation of the third joint in the first rotational direction beyond a predetermined angle formed by the plane defined by the third segment and the plane defined by the fourth segment.

In some implementations, the first segment, the second segment, the third segment, and the fourth segment each include two or more rails each extending between the first end and the second end of their respective segment and one or more slats extending between the two or more rails. In some implementations, the first joint, the second joint, and the third joint each include two or more pivot points each located at a separate one of the two or more rails of adjacent segments. In some implementations, the axes of each of the two or more pivot points are coaxial.

In some implementations, the first segment, the second segment, the third segment, and the fourth segment each include wood.

In some implementations, the first segment, the second segment, the third segment, and the fourth segment each include a single monolithically formed piece.

BRIEF DESCRIPTION OF DRAWINGS

Example features and implementations of the present disclosure are disclosed in the accompanying drawings.

However, the present disclosure is not limited to the precise arrangements and instrumentalities shown. Similar elements in different implementations are designated using the same reference numerals.

DETAILED DESCRIPTION

Figure 1:
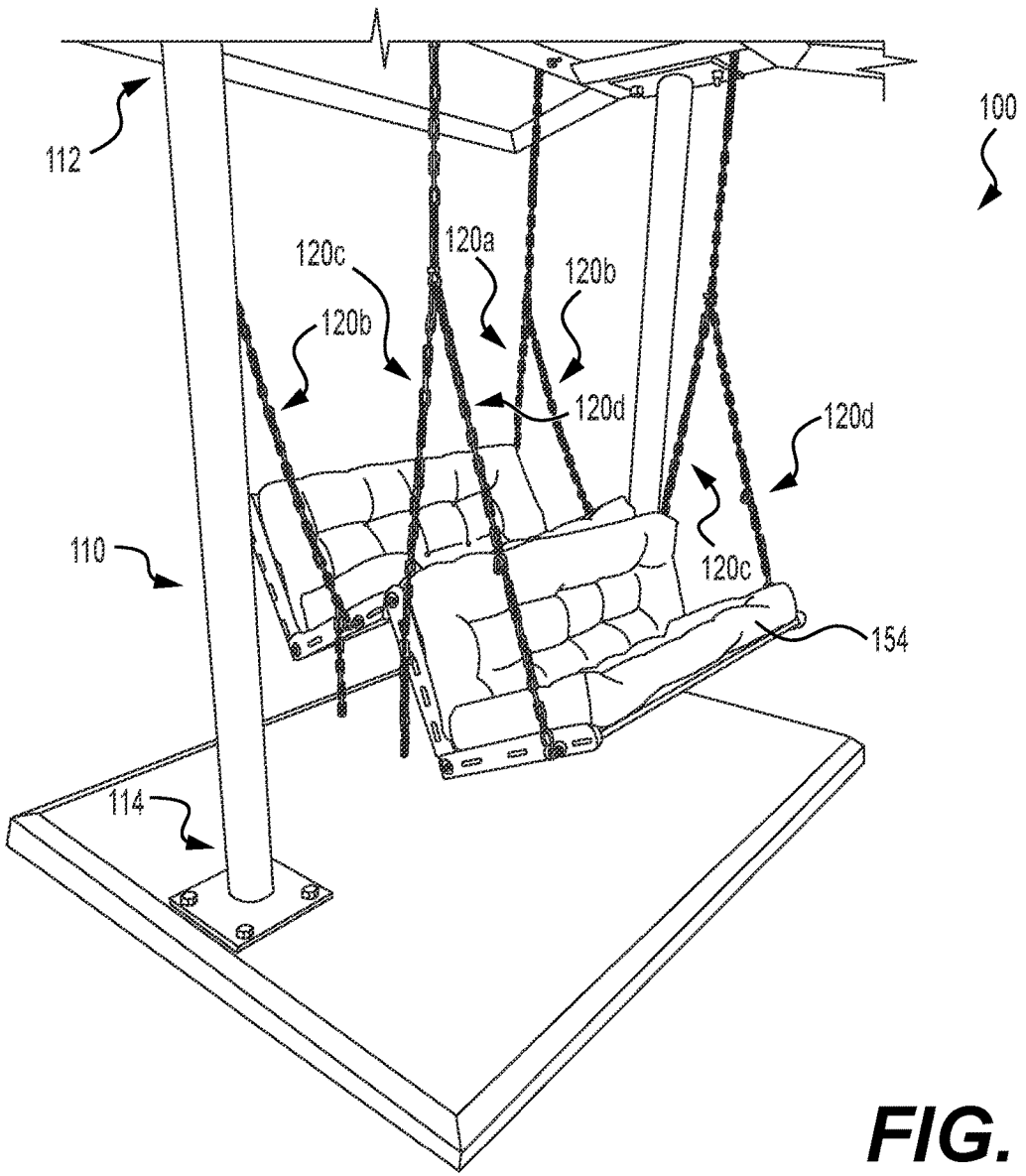
FIG. 1 is a perspective view of a convertible swinging seat assembly in a first configuration, according to one implementation.

The devices, systems, and methods disclosed herein provide for a convertible and configurable swinging or hanging seat such as a bench or chair. The seat includes four or more segments that are successively pivotably linked to each other. The links are able to rotate freely and independently of any of the other segments. Each segment is suspended by a separate suspender such as a chain or rope, and the length of each suspender is adjustable.

The suspenders are coupled to their respective segments at a point away from the joints between segments such that the moment of the segments cause the joints to naturally bias toward a specific rotational direction by gravity. However, when a person applies a downward force to an upwardly inflected joint or end of a segment, the force is able to overcome the gravitational force and urge the joint or end of a segment to move toward a downwardly inflected position.

By adjusting the various suspender lengths and the location of force applied by a person sitting on the seat, the seat can be caused to convert into a variety of positions. The seat can be configured in multiple different positions such as a reclined/inclined bed, a flat bed, two rows of stadium seating, two center facing benches, or two outwardly facing benches.

Various implementations include a convertible swinging seat assembly. The assembly includes a seat and at least four suspenders. The seat includes a first segment, a second segment, a third segment, and a fourth segment. The first segment has a first end and a second end opposite and spaced apart from the first end of the first segment. The second segment has a first end and a second end opposite and spaced apart from the first end of the second segment. The first end of the second segment is pivotably coupled to the second end of the first segment at a first joint. The third segment has a first end and a second end opposite and spaced apart from the first end of the third segment. The first end of the third segment is pivotably coupled to the second end of the second segment at a second joint. The fourth segment has a first end and a second end opposite and spaced apart from the first end of the fourth segment. The first end of the fourth segment is pivotably coupled to the second end of the third segment at a third joint. The first joint, the second joint, and the third joint are independently pivotable relative to each other. The at least four suspenders each have a first suspender portion and a second suspender portion opposite and spaced apart from the first suspender portion. The second suspender portion of a first suspender is coupled to the first segment, the second suspender portion of a second suspender is coupled to the second segment, the second suspender portion of a third suspender is coupled to the third segment, and the second suspender portion of a fourth suspender is coupled to the fourth segment.

FIGS. 1-7 show a convertible swinging bench assembly 100 having aspects of various implementations. The assembly includes a frame 110, suspenders 120, and a bench 130. Although this assembly includes a bench 130, it should be understood that, in some implementations, the assembly can include any size seat such as a chair. For example, while some seats may have a width of 30 inches or less such that the seat would be sized as a chair. In other implementations, the seat may have a width of 30 inches or more such that the seat would be sized as a bench or sofa for seating two or more people along the width.

The frame 110 shown in FIGS. 1-7 has a first portion 112 and a second portion 114 opposite and space apart from the first portion 112. The second portion 114 of the frame 110 (i.e., the bottom portion) is configured to be located on the ground, a floor, or any other surface. The first portion 112 of the frame 110 (i.e., the top portion) is configured to be disposed higher than the second portion 114 relative to a gravitational axis in use.

Although FIGS. 1-7 show an assembly 100 including a frame 110, in some implementations, the assembly does not include a frame and may be suspended from any other structure.

The assembly 100 includes a first pair of suspenders 120*a*, a second pair of suspenders 120*b*, a third pair of suspenders 120*c*, and a fourth pair of suspenders 120*d*. Each pair of suspenders has a first suspender portion 122 and a second suspender portion 124 opposite and spaced apart from the first suspender portion 122.

The first suspender portions 122 of the first pair of suspenders 120*a* and the fourth pair of suspenders 120*d* are coupled to the first portion 112 of the frame 110. The first suspender portions 122 of the second pair of suspenders 120*b* are coupled to intermediate portions 126 of the first pair of suspenders 120*a*, and the first portions 122 of the third pair of suspenders 120*c* are coupled to intermediate portions 126 of the fourth pair of suspenders 120*d*. However, in some implementations, the assembly includes any number of one or more suspenders. In some implementations, the suspenders do not include a suspender pair and may include only one suspender each or three or more suspenders each. In some implementations, the first portions of any number of one or more of the suspenders are coupled to the first portion of the frame, and the first portions of any number of other one or more of the suspenders are coupled to intermediate portions of the other suspenders.

Although the suspenders 120*a*, 120*b*, 120*c*, 120*d* shown in FIGS. 1-7 each include a chain, in some implementations, one or more of the suspenders includes a rope, a strap, a cable, a rod, a bar, any other elongated structure capable of supporting the bench, or any combination thereof.

The bench 130 includes a first segment 140*a*, a second segment 140*b*, a third segment 140*c*, and a fourth segment 140*d*. Each of the first segment 140*z*, the second segment 140*b*, the third segment 140*c*, and the fourth segment 140*d* have a first end 142 and a second end 144 opposite and spaced apart from the first end 142 of the respective segment 140.

Each of the first segment 140*a*, the second segment 140*b*, the third segment 140*c*, and the fourth segment 140*d* includes two rails 150 extending between the first end 142 and the second end 144 of their respective segment 140. One or more slats 152 extend between the two rails 150 of each segment 140 to couple the rails 150 to each other. Cushions 154 can be disposed on a top surface of the rails 150 and slats 152 to create a cushioned seating surface on the bench 130.

Although the first segment 140*a*, the second segment 140*b*, the third segment 140*c*, and the fourth segment 140*d* shown in FIGS. 1-7 include two rails 150, in some implementations, each segment includes any number of three or more rails. In some implementations, each segment includes any number of one or more slats extending between the two or more rails. Although the first segment 140*a*, the second segment 140*b*, the third segment 140*c*, and the fourth segment 140*d* shown in FIGS. 1-7 include wood, in some implementations, one or more of the segments includes any other material suitable for furniture making.

In some implementations, the first segment, the second segment, the third segment, and/or the fourth segment do not include rails or slats. In such implementations, one or more of the segments includes a single monolithically formed piece, such as a formed piece of plastic or a formed sheet of metal.

As shown in FIGS. 1-7, the first segment 140*a*, the second segment 140*b*, the third segment 140*c*, and the fourth segment 140*d* are pivotably coupled to each other. The first end 142 of the second segment 140*b* is pivotably coupled to the second end 144 of the first segment 140*a* at a first joint 160*a*. The first end 142 of the third segment 140*c* is pivotably coupled to the second end 144 of the second segment 140*b* at a second joint 160*b*. The first end 142 of the fourth segment 140*d* is pivotably coupled to the second end 144 of the third segment 140*c* at a third joint 160*c*.

The first joint 160*a* includes two pivot points 162, 164. A first pivot point 162 of the first joint 160*a* is located at the pivotable coupling of the second end 144 of a first rail 150 of the first segment 140*a* and the first end 142 of a first rail 150 of the second segment 140*b*. The second pivot point 164 of the first joint 160*a* is located at the pivotable coupling of the second end 144 of a second rail 150 of the first segment 140*a* and the first end 142 of a second rail 150 of the second segment 140*b*. The axis 166 of the first pivot point 162 and the axis 168 of the second pivot point 164 of the first joint 160*a* are coaxial to allow the first segment 140*a* to rotate relative to the second segment 140*b* about the coaxial axes 166, 168.

The second joint 160*b* also includes two pivot points 162, 164. A first pivot point 162 of the second joint 160*b* is located at the pivotable coupling of the second end 144 of the first rail 150 of the second segment 140*b* and the first end 142 of a first rail 150 of the third segment 140*c*. The second pivot point 164 of the second joint 160*b* is located at the pivotable coupling of the second end 144 of the second rail 150 of the second segment 140*b* and the first end 142 of a second rail 150 of the third segment 140*c*. The axis 166 of the first pivot point 162 and the axis 168 of the second pivot point 164 of the second joint 160*b* are coaxial to allow the second segment 140*b* to rotate relative to the third segment 140*c* about the coaxial axes 166, 164.

The third joint 160*c* further includes two pivot points 162, 164. A first pivot point 162 of the third joint 160*c* is located at the pivotable coupling of the second end 144 of the first rail 150 of the third segment 140*c* and the first end 142 of a first rail 150 of the fourth segment 140*d*. The second pivot point 164 of the third joint 160*c* is located at the pivotable coupling of the second end 144 of the second rail 150 of the third segment 140*c* and the first end 142 of a second rail 150 of the fourth segment 140*d*. The axis 166 of the first pivot point 162 and the axis 168 of the second pivot point 164 of the third joint 160*c* are coaxial to allow the third segment 140*c* to rotate relative to the fourth segment 140*d* about the coaxial axes 166, 168.

The first segment 140*a* and the second segment 140*b* are able to freely rotate about the first joint 160*a* in a first rotational direction 170 and a second rotational direction 172 that is rotationally opposite from the first rotational direction 170. The second segment 140*b* and the third segment 140*c* are able to freely rotate about the second joint 160*b* in the first rotational direction 170 and the second rotational direction 172, and the third segment 140*c* and the fourth segment 140*d* are able to freely rotate about the third joint 160*c* in the first rotational direction 170 and the second rotational direction 172. However, in some implementations, it may be desirable to prevent over rotation of the joints in the first rotational direction, the second rotational direction, or both beyond a predetermined angle of the respective segments.

The first joint 160*a* includes a first primary hard stop 180 and a first secondary hard stop 182. The first primary hard stop 180 prevents over-rotation of the first joint 160*a* in the second rotational direction 172 beyond a plane defined by the first segment 140*a* and a plane defined by the second segment 140*b* being parallel to each other. The first secondary hard stop 182 prevents over-rotation of the first joint 160*a* in the first rotational direction 170 beyond a first predetermined angle 174 formed by the plane defined by the first segment 140*a* and the plane defined by the second segment 140*b*. Thus, the first joint 160*a* is able to freely rotate between a first position in which the plane defined by the first segment 140*a* and the plane defined by the second segment 140*b* are parallel to each other and a second position in which the plane defined by the first segment 140*a* and the plane defined by the second segment 140*b* are rotated in the first rotational direction 170 to the first predetermined angle 174.

Figure 2:
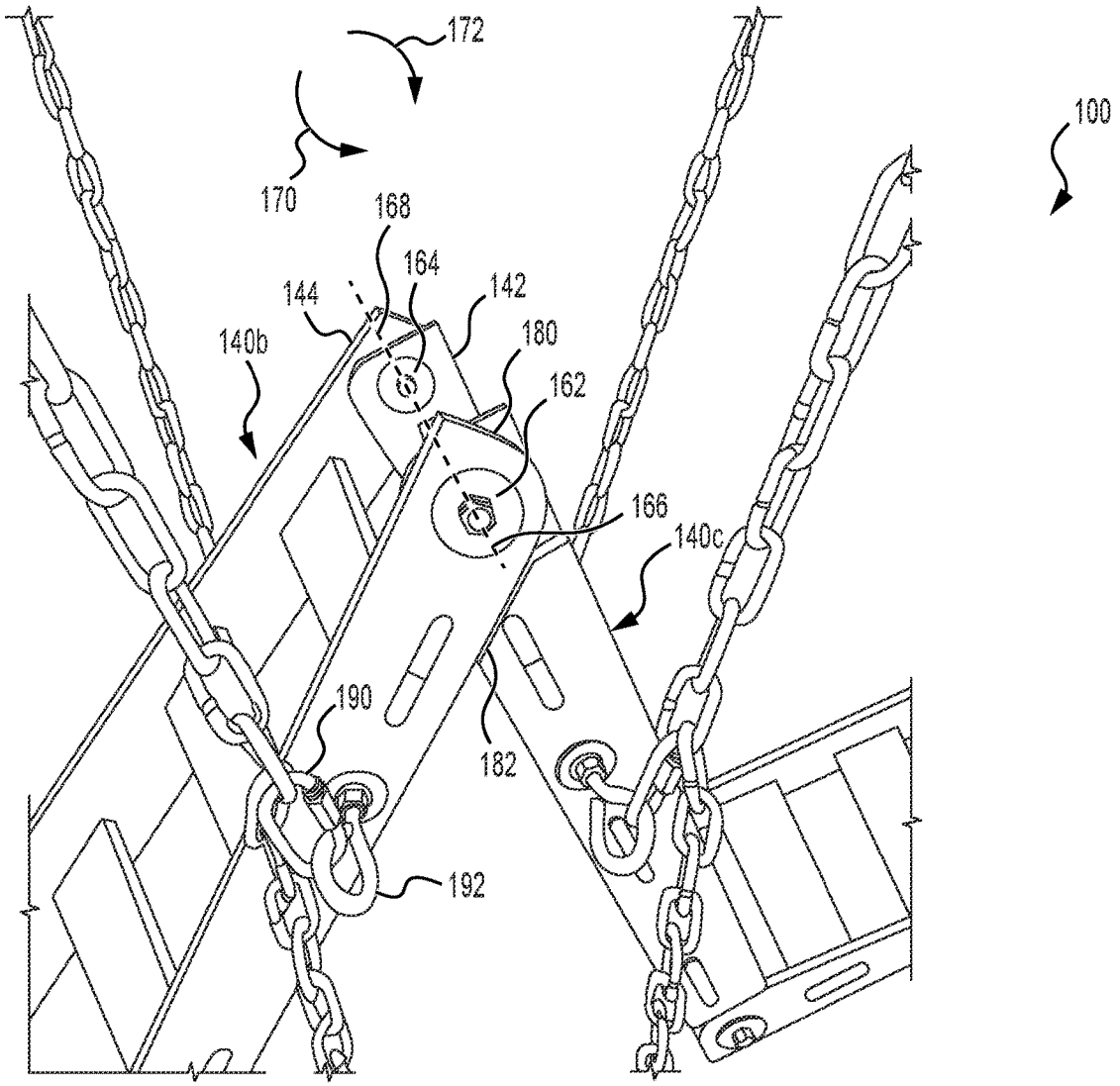
FIG. 2 is a detailed view of a joint of the convertible swinging seat assembly of FIG. 1.

The second joint 160*b* shown in FIG. 2 includes a second primary hard stop 180 and a second secondary hard stop 182, opposite but similar to the first primary hard stop 180 and the first secondary hard stop 182, respectively. The second primary hard stop 180 prevents over-rotation of the second joint 160*b* in the first rotational direction 170 beyond the plane defined by the second segment 140*b* and a plane defined by the third segment 140*c* being parallel to each other. The second secondary hard stop 182 prevents over-rotation of the second joint 160*b* in the second rotational direction 172 beyond a second predetermined angle 176 formed by the plane defined by the second segment 140*b* and the plane defined by the third segment 140*c*. Thus, the second joint 160*b* is able to freely rotate between a first position in which the plane defined by the second segment 140*b* and the plane defined by the third segment 140*c* are parallel to each other and a second position in which the plane defined by the second segment 140*b* and the plane defined by the third segment 140*c* are rotated in the second rotational direction 172 (in the opposite rotational direction as the first joint 160*a*) to a second predetermined angle 176.

The third joint 160*c* includes a third primary hard stop 180 and a third secondary hard stop 182, similar to the first primary hard stop 180 and the first secondary hard stop 182, respectively. The third primary hard stop 180 prevents over-rotation of the third joint 160*c* in the second rotational direction 172 beyond a plane defined by the third segment 140*c* and a plane defined by the fourth segment 140*d* being parallel to each other. The third secondary hard stop 182 prevents over-rotation of the third joint 160*c* in the first rotational direction 170 beyond a third predetermined angle 178 formed by the plane defined by the third segment 140*c* and the plane defined by the fourth segment 140*d*. Thus, the third joint 160*c* is able to freely rotate between a first position in which the plane defined by the third segment 140*c* and the plane defined by the fourth segment 140*d* are parallel to each other and a second position in which the plane defined by the third segment 140*c* and the plane defined by the fourth segment 140*d* are rotated in the first rotational direction 170 (in the same rotational direction as the first joint 160*a* and in the opposite rotational direction as the second joint 160*b*) to a third predetermined angle 178.

Each of the suspenders 120*a*, 120*b*, 120*c*, 120*d* in the pairs of suspenders is coupled to an opposite side of a respective segment 140*a*, 140*b*, 140*c*, 140*d*. The second suspender portion 124 of the first pair of suspenders 120*a* is coupled to the first segment 140*a* adjacent to the first end 142 of the first segment 140*a*. The second suspender portion 124 of the second pair of suspenders 120*b* is coupled to the second segment 140*b* adjacent to the second end 144 of the second segment 140*b* such that the second pair of suspenders 120*b* is coupled closer to the second joint 160*b* than it is to the first joint 160*a*. The second suspender portion 124 of the third pair of suspenders 120*c* is coupled to the third segment 140*c* adjacent to the first end 142 of the third segment 140*c* such that the third pair of suspenders 120*c* is coupled closer to the second joint 160*b* than it is to the third joint 160*c*. The second suspender portion 124 of a fourth pair of suspenders 120*d* is coupled to the fourth segment 140*d* adjacent to the second end 144 of the fourth segment 140*d*.

The second suspender portion 124 of each of the suspenders 120*a*, 120*b*, 120*c*, 120*d* shown in FIGS. 1-7 includes a quick link 190 coupled to an eye hook 192 of the respective segment 140*a*, 140*b*, 140*c*, 140*d* of the bench 130. The quick link 190 can be decoupled from the respective suspender 120*a*, 120*b*, 120*c*, 120*d* and recoupled to a different portion of the suspender 120*a*, 120*b*, 120*c*, 120*d* to adjust the location of the second suspender portion 124. Thus, the quick link 190 allows the distance between the first suspender portion 122 and the second suspender portion 124 of each of the suspenders 120*a*, 120*b*, 120*c*, 120*d* to be adjustable. This allows a user to adjust the portion of a given segment 140*a*, 140*b*, 140*c*, 140*d* of the bench 130 to which the respective suspender 120*a*, 120*b*, 120*c*, 120*d* is coupled relative to the other segments 140*a*, 140*b*, 140*c*, 140*d* of the bench 130, as discussed below.

Although the second suspender portions 124 of each of the suspenders 120*a*, 120*b*, 120*c*, 120*d* shown in FIGS. 1-7 includes a quick link 190, in some implementations, the second suspender portion of one or more of the suspenders includes a carabiner, a hook, a fastener, any other means of rotationally or flexibly coupling the second suspender portion to a segment of the bench, or any combination thereof. In some implementations, the first suspender portion of one or more of the suspenders is adjustable relative to the frame to allow for adjustment of the frame segments relative to each other.

In use, the lengths of each of the suspenders 120*a*, 120*b*, 120*c*, 120*d* can be adjusted to set a desired distance between the first suspender portion 122 and the second suspender portion 124. This adjustment of the suspenders 120*a*, 120*b*, 120*c*, 120*d* raises or lowers the connection point of the respective segment 140*a*, 140*b*, 140*c*, 140*d* of the bench 130 to which the suspender 120*a*, 120*b*, 120*c*, 120*d* is coupled. The coupling of the suspenders 120*a*, 120*b*, 120*c*, 120*d* to a segment 140*a*, 140*b*, 140*c*, 140*d* of the bench 130 creates a pivot point from which the segment 140*a*, 140*b*, 140*c*, 140*d* is suspended. Because the suspenders 120*a*, 120*b*, 120*c*, 120*d* are coupled to portions of the bench segments 140*a*, 140*b*, 140*c*, 140*d* that are closer to one end 122, 124 of the segment 140*a*, 140*b*, 140*c*, 140*d* than the other and are spaced apart from the joints 160*a*, 160*b*, 160*c*, the moments of the segments 140*a*, 140*b*, 140*c*, 140*d* cause the joints 160*a*, 160*b*, 160*c* to naturally bias toward a specific rotational direction 170, 172 due to gravity acting on the mass of the segments 140*a*, 140*b*, 140*c*, 140*d*. The lowering and raising of the coupling points of the suspenders 120*a*, 120*b*, 120*c*, 120*d* to the segments 140*a*, 140*b*, 140*c*, 140*d* changes the relative heights of the segment pivot point and the joints 160*a*, 160*b*, 160*c*. Because the direction of gravity remains constant, the change in the relative heights of the segment pivot points and the joints 160*a*, 160*b*, 160*c* changes the moments of the segments 140*a*, 140*b*, 140*c*, 140*d* about the coupling point of the suspenders 120*a*, 120*b*, 120*c*, 120*d* to the segments 140*a*, 140*b*, 140*c*, 140*d*, which causes the bench 130 to naturally settle into different positions.

Furthermore, when a user sits on, and applies additional force to, one or more points on the segments 140*a*, 140*b*, 140*c*, 140*d* or joints 160*a*, 160*b*, 160*c*, the moments of the segments 140*a*, 140*b*, 140*c*, 140*d* are again altered. Thus, a user can position themselves on certain raised portions of the bench segments 140*a*, 140*b*, 140*c*, 140*d* to force those portions to lower while the opposite ends of those segments 140*a*, 140*b*, 140*c*, 140*d* rise. This allows a user to adjust their body on the bench 130 to cause the bench 130 to convert to other positions.

The hard stops 180, 182 of the joints 160*a*, 160*b*, 160*c* are utilized to prevent portions of the bench 130 from "folding up" and collapsing downwardly in on themselves or to prevent portions of the bench 130 from "folding out" and the ends of the bench 130 from collapsing downwardly. Thus, the hard stops 180, 182 prevent the bench 130 from moving into undesirable configurations.

Figure 3:
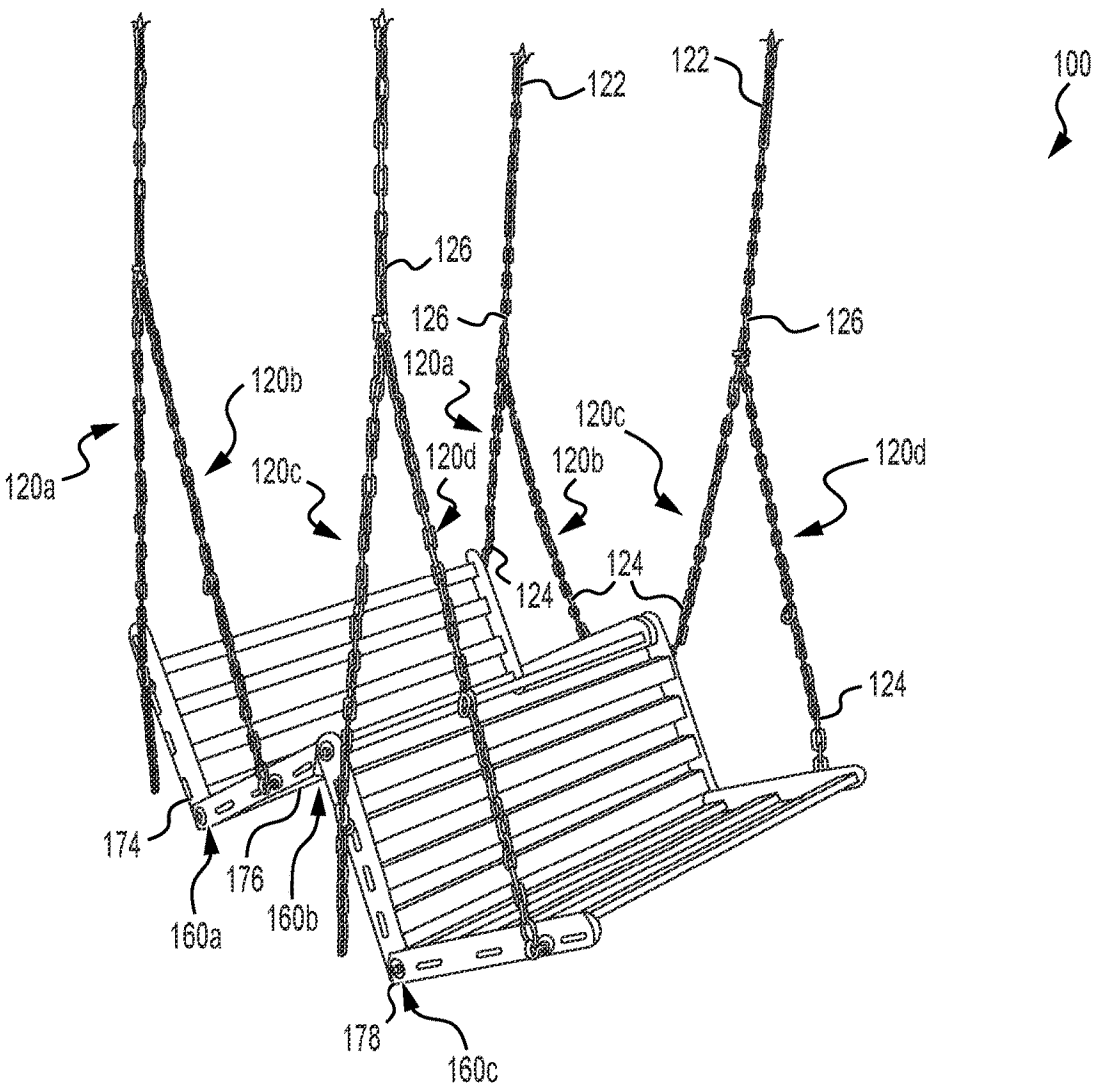
FIG. 3 is a perspective view of the bench and suspenders of the convertible swinging seat assembly of FIG. 1.

FIGS. 1 and 3 shows the bench 130 in a stadium seating configuration. The second portion 124 of the first suspender 120*a* is located higher than the second portion 124 of the second suspender 120*b*, the second portion 124 of the second suspender 120*b* is located higher than the second portion 124 of the third suspender 120*c*, and the second portion 124 of the third suspender 120*c* is located higher than the second portion 124 of the fourth suspender 120*d*. This configuration allows one or more users to sit on the second segment 140*b* with their back along the first segment 140*a* and feet on the fourth segment 140*d* and one or more other users to sit on the fourth segment 140*d* with their back along the third segment 140*c* and their feet hanging from the end.

Figure 4:
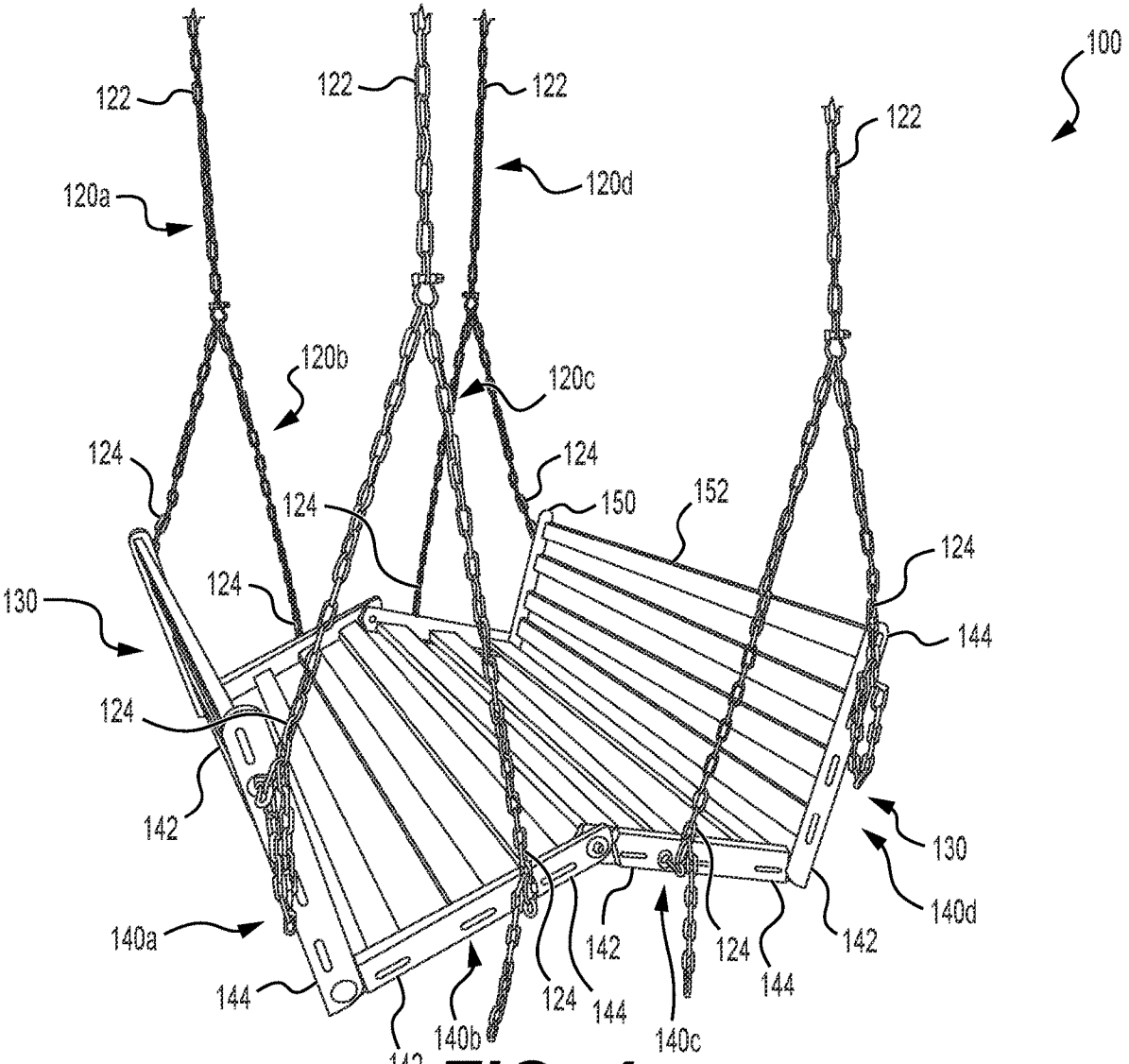
FIG. 4 is a perspective view of the convertible swinging seat assembly of FIG. 1 in a second configuration.

FIG. 4 shows the bench 130 in a two center facing benches configuration. The second portion 124 of the first suspender 120*a* is located higher than the second portion 124 of the second suspender 120*b*, the second portion 124 of the second suspender 120*b* is located at the same height as the second portion 124 of the third suspender 120*c*, and the second portion 124 of the third suspender 120*c* is located lower than the second portion 124 of the fourth suspender 120*d*. This configuration allows one or more users to sit on the second segment 140*b* with their back along the first segment 140*a* and legs along the third segment 140*c* and one or more other users to sit on the third segment 140*c* with their back along the fourth segment 140*d* and legs along the second segment 140*b*.

Figure 5:
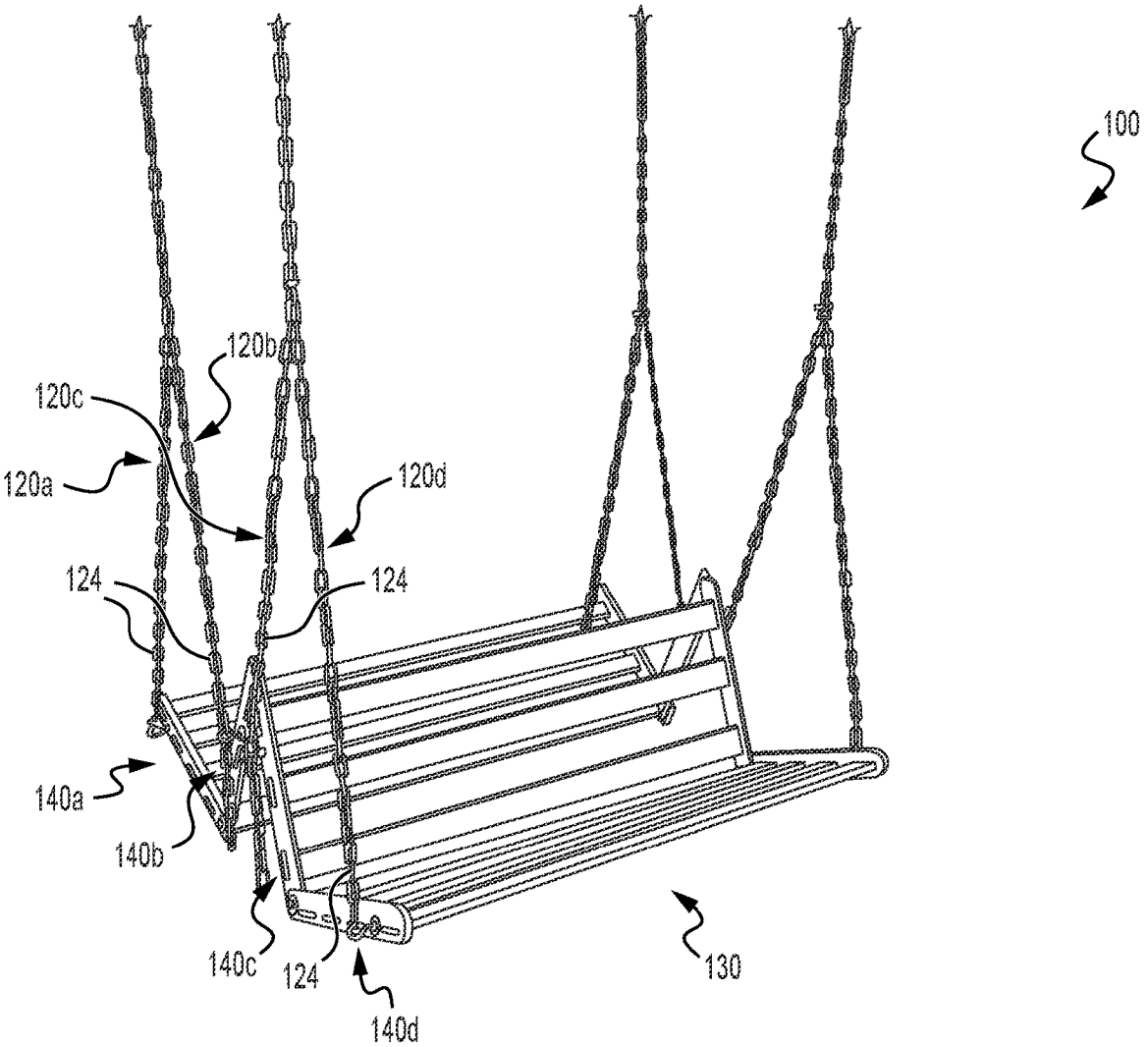
FIG. 5 is a perspective view of the convertible swinging seat assembly of FIG. 1 in a third configuration.

FIG. 5 shows the bench 130 in a two outwardly facing benches configuration. The second portion 124 of the first suspender 120*a* is located lower than the second portion 124 of the second suspender 120*b*, the second portion 124 of the second suspender 120*b* is located at the same height as the second portion 124 of the third suspender 120*c*, and the second portion 124 of the third suspender 120*c* is located higher than the second portion 124 of the fourth suspender 120*d*. This configuration allows one or more users to sit on the first segment 140*a* with their back along the second segment 140*b* and their feet hanging from the end and one or more other users to sit on the fourth segment 140*d* with their back along the third segment 140*c* and their feet hanging from the opposite end.

Figure 6:
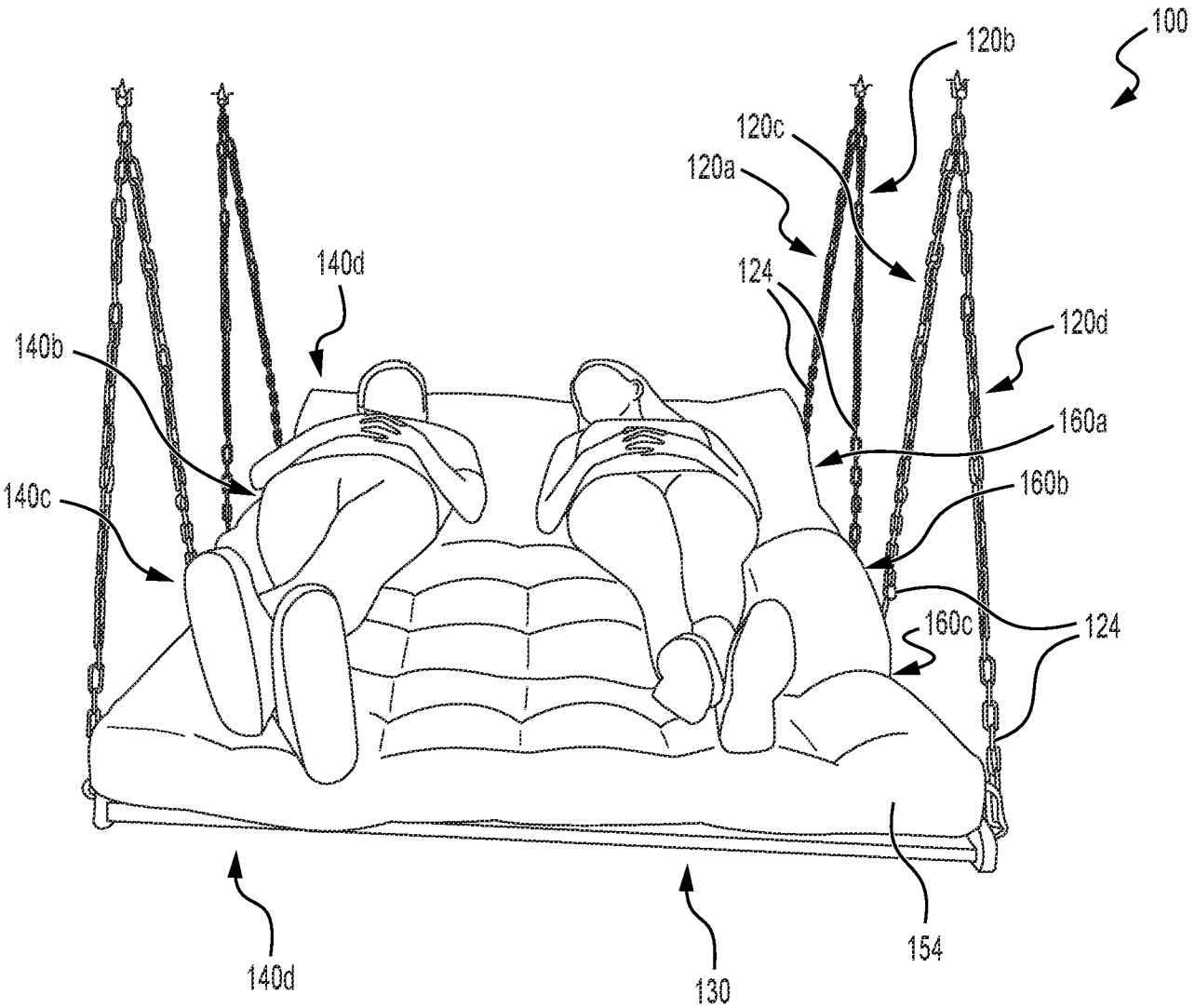
FIG. 6 is a perspective view of the convertible swinging seat assembly of FIG. 1 in a fourth configuration.

FIG. 6 shows the bench 130 in a flat bed configuration. The second portion 124 of each of the suspenders 120*a*, 120*b*, 120*c*, 120*d* is located at the same height as the second portion 124 of the other suspenders 120*a*, 120*b*, 120*c*, 120*d*. Due to the locations of the pivot points created by the coupling of the suspenders 120*a*, 120*b*, 120*c*, 120*d* to their segments 140*a*, 140*b*, 140*c*, 140*d*, the bench 130 is biased toward a W-shape. However, one or more users can place their hips (and thus, a large portion of their weight) along the second joint 160*b* to urge the second joint 160*b* downwardly. The movement of the second joint 160*b* downwardly cause the first joint 160*a* and third joint 160*c* to rise, forming a flat surface upon which the one or more users can lie.

Figure 7:
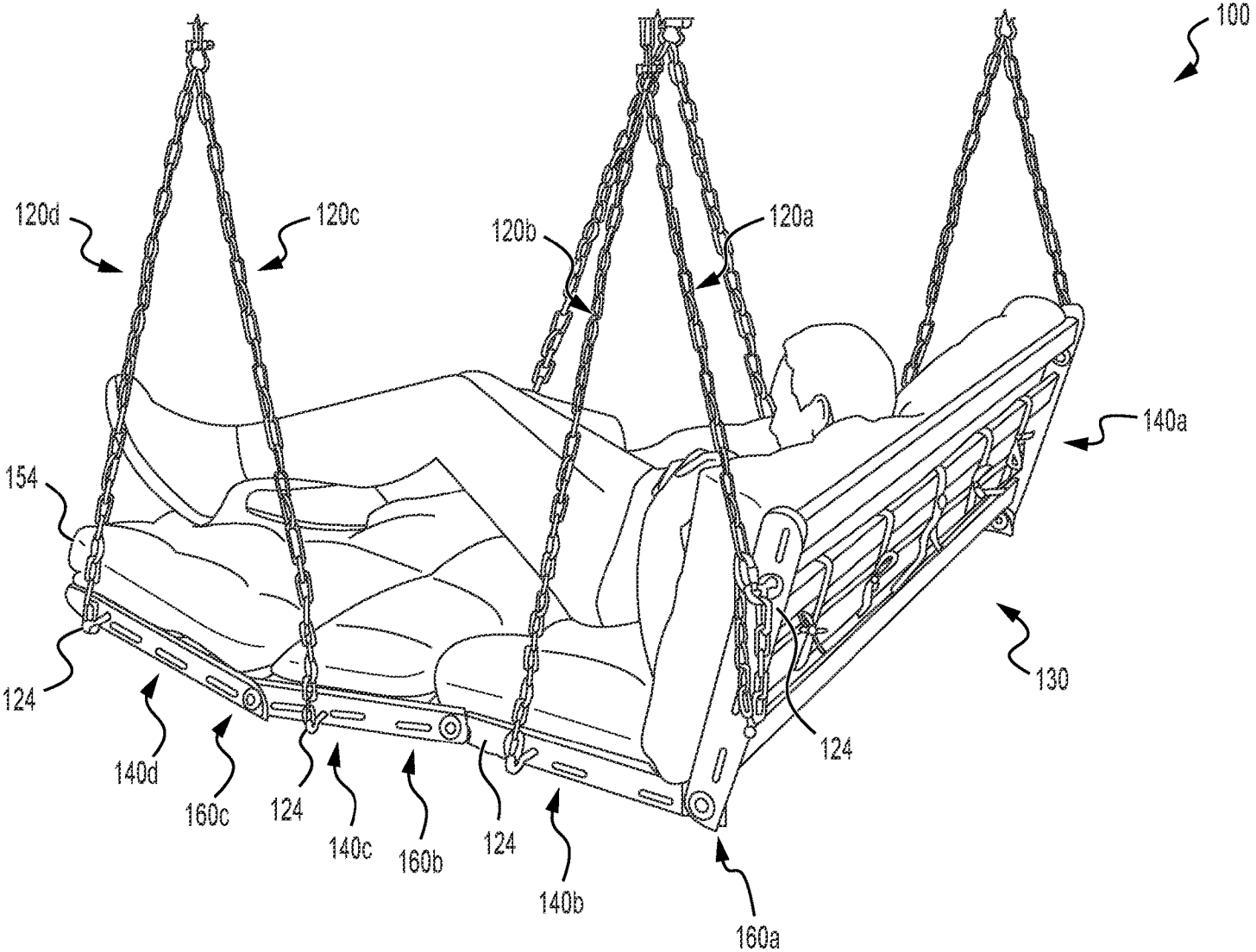
FIG. 7 is a perspective view of the convertible swinging seat assembly of FIG. 1 in a fifth configuration.

FIG. 7 shows the bench 130 in a reclined/inclined bed configuration. The second portion 124 of the first suspender 120*a* is located higher than the second portion 124 of the second suspender 120*b*, and the second portion 124 of each of the second suspender 120*b*, the third suspender 120*c*, and the fourth suspender 120*d* are located at the same height as each other. Similar to the flat bed configuration, due to the locations of the pivot points created by the coupling of the suspenders 120*b*, 120*c*, 120*d* to their segments 140*b*, 140*c*, 140*d*, the second joint 160*b* is biased toward a raised position and the third joint 160*c* is biased toward a lowered position. However, one or more users can place their hips (and thus, a large portion of their weight) along the second joint 160*b* to urge the second joint 160*b* downwardly. The movement of the second joint 160*b* downwardly cause the third joint 160*c* to rise, forming a flat surface on the second segment 140*b*, the third segment 140*c*, and the fourth segment 140*d* upon which the one or more users can lie. Because the second portion 124 of the first suspender 120*a* is raised, the first segment 140*a* forms a seat back along which the one or more users can place their backs.

Although multiple configurations have been described herein, it should be understood that the second portions 124 of the suspenders 120*a*, 120*b*, 120*c*, 120*d* can be varied and the weight of one or more users can be located on the bench 130 to form any number of other configurations.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A convertible swinging seat assembly, the assembly comprising:

a seat comprising:

a first segment having a first end and a second end opposite and spaced apart from the first end of the first segment;

a second segment having a first end and a second end opposite and spaced apart from the first end of the second segment, wherein the first end of the second segment is pivotably coupled to the second end of the first segment at a first joint;

a third segment having a first end and a second end opposite and spaced apart from the first end of the third segment, wherein the first end of the third segment is pivotably coupled to the second end of the second segment at a second joint;

a fourth segment having a first end and a second end opposite and spaced apart from the first end of the fourth segment, wherein the first end of the fourth segment is pivotably coupled to the second end of the third segment at a third joint, wherein the first joint, the second joint, and the third joint are independently pivotable relative to each other, wherein the second joint includes a second primary hard stop, wherein an end portion of the third segment includes a rabbet having a shoulder, the shoulder having a first shoulder portion, wherein the first shoulder portion and an end portion of the second segment form the second primary hard stop, wherein the end portion of the second segment is configured to abut the first shoulder portion to prevent over-rotation of the second joint in a first rotational direction beyond a plane defined by the second segment and a plane defined by the third segment being parallel to each other, and wherein the second joint includes a second secondary hard stop, wherein the shoulder has a second shoulder portion, wherein the second shoulder portion and an edge portion of the second segment form the second secondary hard stop, wherein the edge portion of the second segment is configured to abut the second shoulder portion to prevent over-rotation of the second joint in a second rotational direction beyond a predetermined angle formed by the plane defined by the second segment and the plane defined by the third segment; and at least four suspenders each having a first suspender portion and a second suspender portion opposite and spaced apart from the first suspender portion, wherein the second suspender portion of a first suspender is coupled to the first segment, the second suspender portion of a second suspender is coupled to the second segment, the second suspender portion of a third suspender is coupled to the third segment, and the second suspender portion of a fourth suspender is coupled to the fourth segment.

2. The assembly of claim 1, further comprising a frame having a first portion and a second portion opposite and space apart from the first portion, wherein the first portion is configured to be disposed higher than the second portion relative to a gravitational axis in use, wherein the first suspender portion of one or more of the at least four suspenders is coupled to the first portion of the frame.

3. The assembly of claim 1, wherein the first suspender, the second suspender, the third suspender, and the fourth suspender each comprise a chain.

4. The assembly of claim 1, wherein the first suspender, the second suspender, the third suspender, and the fourth suspender each comprise a rope.

5. The assembly of claim 1, wherein each suspender comprises a pair of suspenders, wherein each of the suspenders in the pair of suspenders is coupled to an opposite side of a respective segment.

6. The assembly of claim 1, wherein the second suspender portion of the second suspender is coupled to a portion of the second segment spaced apart from the first joint and the second joint, and the second suspender portion of the third suspender is coupled to a portion of the third segment spaced apart from the second joint and the third joint.

7. The assembly of claim 6, wherein the portion of the second segment to which the second suspender portion of the second suspender is coupled is closer to the second joint than it is to the first joint, and the portion of the third segment to which the second suspender portion of the third suspender is coupled is closer to the second joint than it is to the third joint.

8. The assembly of claim 1, wherein a distance between the first suspender portion and the second suspender portion of each of the at least four suspenders is adjustable.

9. The assembly of claim 8, wherein the second suspender portion comprises a quick link.

10. The assembly of claim 8, wherein the second suspender portion comprises a carabiner.

11. The assembly of claim 8, wherein the second suspender portion comprises a hook.

12. The assembly of claim 1, wherein the first joint includes a first primary hard stop and the third joint includes a third primary hard stop, wherein the first primary hard stop prevents over-rotation of the first joint in a second rotational direction beyond a plane defined by the first segment and the plane defined by the second segment being parallel to each other, and wherein the third primary hard stop prevents over-rotation of the third joint in the second rotational direction beyond the plane defined by the third segment and a plane defined by the fourth segment being parallel to each other.

13. The assembly of claim 12, wherein the first joint includes a first secondary hard stop and the third joint includes a third secondary hard stop, wherein the first secondary hard stop prevents over-rotation of the first joint in the first rotational direction beyond a predetermined angle formed by the plane defined by the first segment and the plane defined by the second segment, and wherein the third secondary hard stop prevents over-rotation of the third joint in the first rotational direction beyond a predetermined angle formed by the plane defined by the third segment and the plane defined by the fourth segment.

14. The assembly of claim 1, wherein the first segment, the second segment, the third segment, and the fourth segment each comprise:

two or more rails each extending between the first end and the second end of their respective segment; and one or more slats extending between the two or more rails.

15. The assembly of claim 14, wherein the first joint, the second joint, and the third joint each comprise:

two or more pivot points each located at a separate one of the two or more rails of adjacent segments, wherein the axes of each of the two or more pivot points are coaxial.

16. The assembly of claim 1, wherein the first segment, the second segment, the third segment, and the fourth segment each comprise wood.

17. The assembly of claim 1, wherein each of the first segment, the second segment, the third segment, and the fourth segment have a width as measured in a direction parallel to a rotational axis of the first joint, the second joint, and the third joint, wherein the width is 30 inches or greater.

* * * * *